US008523303B2

(12) United States Patent
Arslankiray et al.

(10) Patent No.: US 8,523,303 B2
(45) Date of Patent: Sep. 3, 2013

(54) COOLING DEVICE WITH SPACING ELEMENT

(75) Inventors: Ziya Arslankiray, Tekirdag (TR); Cemalettin Hastürk, Tekirdag (TR); Mehmet Savan, Tekirdag (TR); Özgür Ölmez, Tekirdag (TR)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/298,333

(22) Filed: Nov. 17, 2011

(65) Prior Publication Data

US 2012/0146478 A1 Jun. 14, 2012

(30) Foreign Application Priority Data

Dec. 13, 2010 (TR) ..... a 2010 10403

(51) Int. Cl.
*A47B 96/04* (2006.01)

(52) U.S. Cl.
USPC ..... 312/405; 312/293.1; 312/348.4

(58) Field of Classification Search
USPC ..... 312/405, 405.1, 406, 407, 293.1, 312/348.4; 62/331; 49/501; 52/800.1
See application file for complete search history.

(56) References Cited

U.S. PATENT DOCUMENTS

| | | | | |
|---|---|---|---|---|
| 3,731,035 | A * | 5/1973 | Jarvis et al. | 219/740 |
| 3,885,351 | A * | 5/1975 | Imperial et al. | 49/501 |
| 3,949,526 | A * | 4/1976 | Sherlock et al. | 49/501 |
| 5,214,880 | A * | 6/1993 | Woodruff et al. | 49/490.1 |
| 5,306,082 | A * | 4/1994 | Karlin et al. | 312/405 |
| 5,975,663 | A * | 11/1999 | Becker | 312/405 |
| 6,311,454 | B1 * | 11/2001 | Kempel | 52/784.15 |
| 6,679,006 | B2 * | 1/2004 | Banicevic et al. | 49/501 |
| 6,961,988 | B2 * | 11/2005 | Koons | 29/525.11 |
| 2004/0163323 | A1 * | 8/2004 | Herrmann et al. | 49/501 |
| 2005/0069997 | A1 * | 3/2005 | Adkesson et al. | 435/158 |
| 2006/0152126 | A1 * | 7/2006 | Collins et al. | 312/407 |
| 2009/0039750 | A1 * | 2/2009 | Laible et al. | 312/405 |
| 2009/0045705 | A1 | 2/2009 | Laible et al. | |
| 2010/0327720 | A1 * | 12/2010 | Pae | 312/405 |
| 2011/0273071 | A1 * | 11/2011 | Kim et al. | 312/405 |

FOREIGN PATENT DOCUMENTS

| | | | |
|---|---|---|---|
| DE | 29811084 | U1 | 9/1998 |
| EP | 0108677 | A1 | 5/1984 |
| EP | 0647821 | B1 | 4/1995 |

OTHER PUBLICATIONS

English translation of EP0108677 from espacenet.com.*
National Search Report EP 11 19 2285.

* cited by examiner

*Primary Examiner* — Darnell Jayne
*Assistant Examiner* — Daniel Rohrhoff
(74) *Attorney, Agent, or Firm* — James E. Howard; Andre Pallapies

(57) ABSTRACT

A refrigerator having a deep freeze compartment door with an aluminum profile having lateral coverings at both sides and an additional guiding means mounted on a panel fixing element. The panel fixing element is embedded with the outer part of the door such that an ornamental spacing element is fixed to the guiding element and to the lateral coverings such that an easier on site mounting is obtained and a more appealing visual effect is achieved.

8 Claims, 3 Drawing Sheets

COOLING DEVICE WITH SPACING ELEMENT

BACKGROUND OF THE INVENTION

The present invention relates to an intermediate spacing element located in between an outer shell of a refrigerator door and its innermost part such that a more pleasing visual effect is obtained.

The present invention relates to an intermediate ornamental spacing element located in between an outer shell of a refrigerator door and its innermost part such that a more pleasing visual effect is obtained. To this end, the present invention provides a refrigerator door having an outer part spaced from its innermost frame part such that both an easier mounting is effected and a more pleasing visual effect due to the spacing element is obtained.

More specifically, the present invention concerns the upper door of a refrigerator, which is conventionally provided for deep freeze compartments thereof. Upper compartments of refrigerators are conventionally equipped with doors having plastic coverings fixed on the panel fixing elements on the door frame by means of respective claws. The reason that said coverings are not fixedly attached to the panel elements on the door frame is dependent on material selection and basically plastic claws do not adequately support the mechanical connection in between the panels and the frame. To this end, even a small amount of force can cause breaking and/or demounting of said upper coverings.

Further, it is also desired that a more robust material selection, leading to elimination of shortcomings such as bending and/or displacement of said coverings in time, is made. To this effect, a plastic covering is replaced with a more robust material to eliminate such disadvantages.

BRIEF SUMMARY OF THE INVENTION

The most prominent object of the present invention is to provide a refrigerator upper compartment door covering fixedly attached to a panel element on the door frame of said refrigerator's compartment door.

Another object of the present invention is to provide a refrigerator upper compartment door in which bending and/or displacement of said door's upper coverings is eliminated.

The present invention provides a refrigerator having a deep freeze compartment door with an aluminum profile having lateral coverings at both sides and an additional guiding means mounted on a panel fixing element. Said panel fixing element is embedded with the outer part of the door such that an ornamental spacing element is fixed to said guiding element and to said lateral coverings such that an easier on site mounting is obtained and a more appealing visual effect is achieved.

BRIEF DESCRIPTION OF THE DRAWINGS

The figures whose brief explanations are herewith provided are solely intended for providing a better understanding of the present invention and are as such not intended to define the scope of protection or the context in which said scope is interpreted in the absence of the description. To this end, FIG. 1 demonstrates a perspective view of the lateral coverings according to the present invention.

DETAILED DESCRIPTION OF EXEMPLARY EMBODIMENTS OF THE PRESENT INVENTION

Figure 1:
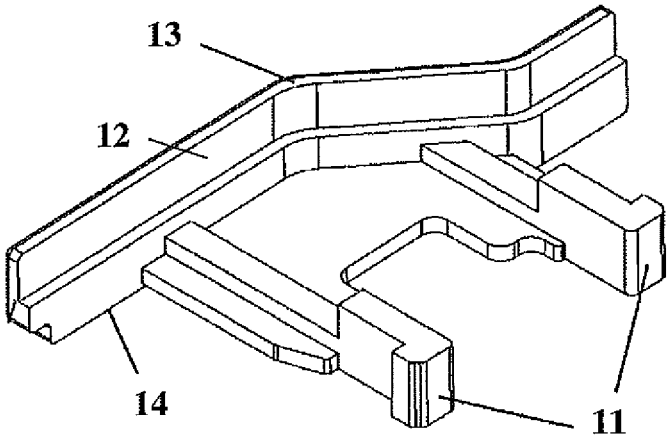
Figure 2:
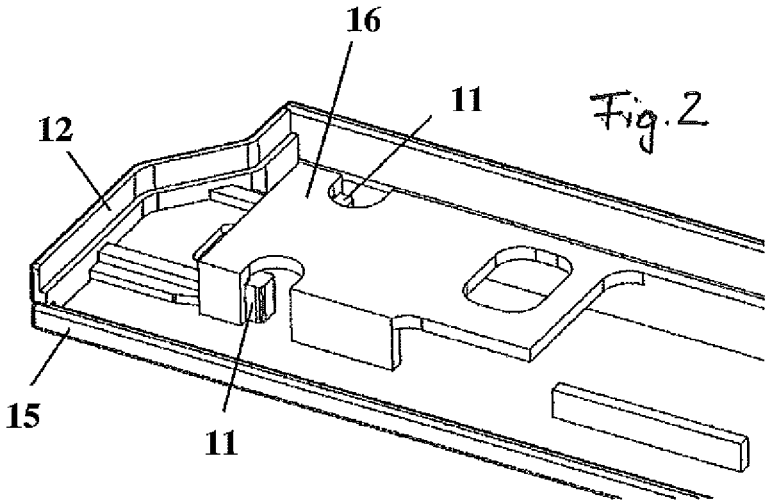
FIG. 2 demonstrates a perspective view of a lateral covering with an aluminum profile according to the present invention.

The present invention proposes a refrigerator door system having lateral coverings (12) as in FIG. 1 with claws (11) for engagement with an aluminum profile (15) as shown in FIG. 2. Said lateral covering (12) has an outer side (13) and an inner side (14) adjoined to a deep freeze compartment door unit body. Said aluminum profile (15) has a lower surface (16) facing the refrigerator's main door below.

Figure 3:
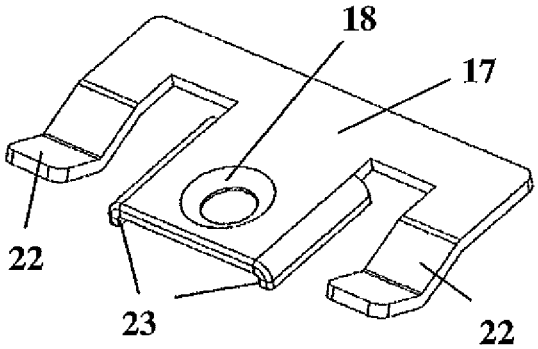
FIG. 3 demonstrates a perspective view of the additional guiding means according to the present invention.
Figure 4A:
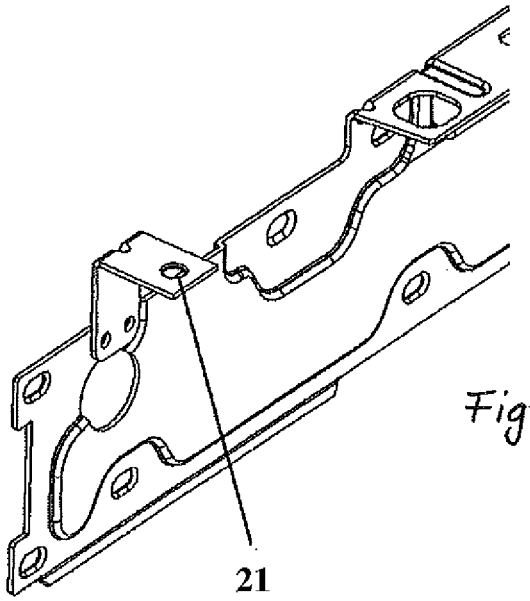
FIG. 4*a* demonstrates a perspective view of the panel fixing element and FIG. 4*b* demonstrates the additional guiding means mounted on said fixing element according to the present invention.
Figure 4B:
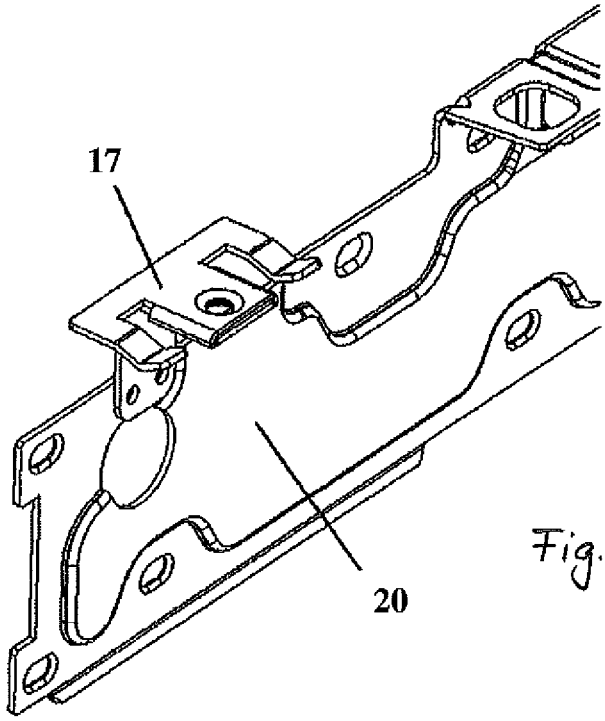

FIG. 3 demonstrates an additional guiding means (17) with a mounting hole (18) by means of which the ornamental element (19) according to the present invention is fixed. Said guiding means (17) is attached on the panel fixing element (20) by means of a fixing hole (21) as seen in FIGS. 4*a* and 4*b*. Said additional guiding means (17) has lateral claws (22) and restrictive end parts (23) in the middle.

Figure 5A:
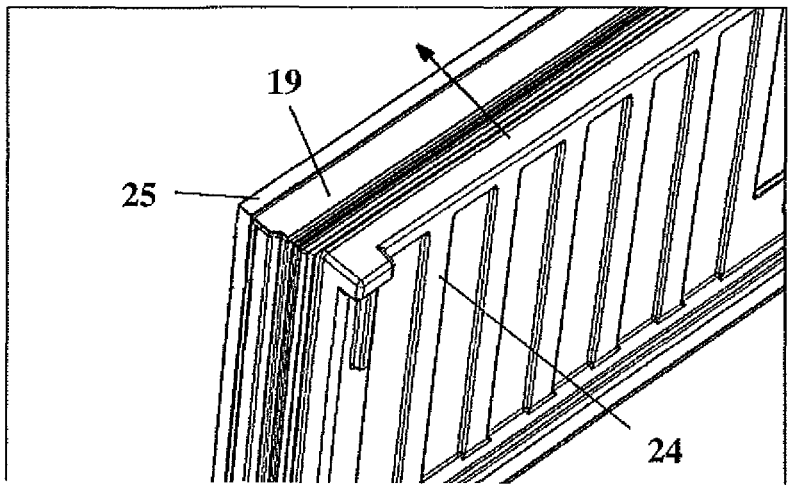
FIG. 5*a* demonstrates a perspective view of the deep freeze compartment door according to the present invention.
Figure 5B:
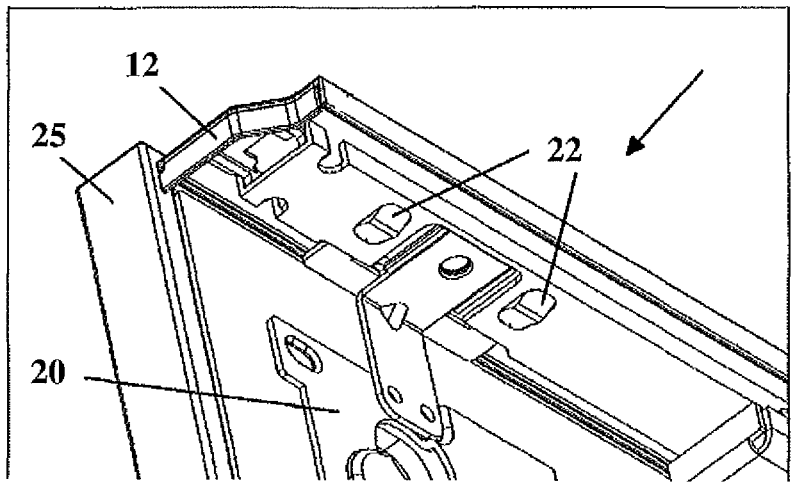
FIG. 5*b* demonstrates said deep freeze compartment door upside down where said additional guiding means is seen.

FIGS. 5*a* and 5*b* explain the way the ornamental element (19) is mounted on the deep freeze door. To this end, said door has an inner surface (24) and an outer shell (25). As seen in FIG. 5*b*, said panel fixing element (20) is located on the outer part of the door and is embedded within said outer shell (25). Said ornamental spacing element (19) is introduced and settled in the direction of the arrows as indicated in FIGS. 5*a* and 5*b*.

Figure 6:
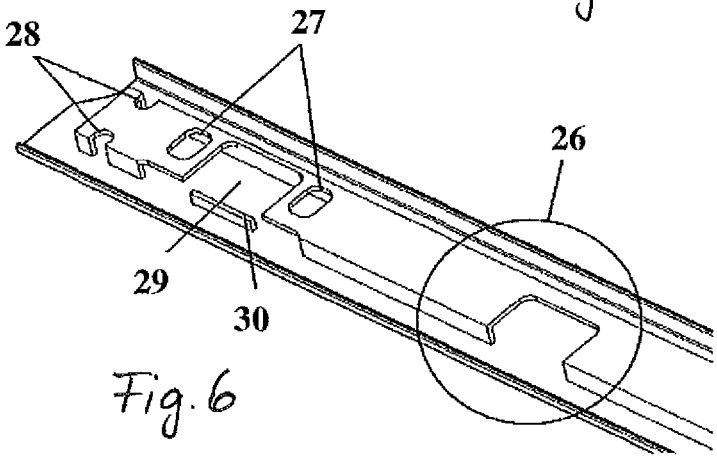
FIG. 6 demonstrates a perspective view of the aluminum profile with its openings according to the present invention.

As seen in FIG. 6, the aluminum profile (15) comprises a plurality of emptied parts, namely, an emptied profile part (26) for bearings, a pair of openings (27) for additional guiding means' (17) claws (22), openings (28) for mounting lateral coverings (12), additional guiding means (17) slot (29) and a protrusion (30) for restricting the same in its mounted position.

In a nutshell, the present invention provides a household appliance door having a panel fixing element (20) located on the outer part of the door being embedded within said outer shell (25). Said panel fixing element (20) is attached to a guiding means (17). Said door further comprises lateral coverings (12) for engagement with an aluminum profile (15). An ornamental spacing element (19) is provided in said door such that said ornamental spacing element (19) is fixedly delimited by said guiding means (17) on which said aluminum profile (15) is attached.

What is claimed is:

1. A household appliance door, comprising:

an outer shell;

a panel fixing element located on an outer part of the door and embedded within the outer shell;

a guide attached to the panel fixing element;

an aluminum profile attached to the guide;

a lateral covering engaging the aluminum profile; and an ornamental spacing element fixed to the aluminum profile by the guide.

2. The household appliance door of claim 1, wherein the lateral covering has claws that engage the aluminum profile.

3. The household appliance door of claim 1, wherein the household appliance door is a door of a deep freeze compartment, wherein the door has a unit body, and wherein the lateral covering has an outer side and an inner side adjoined to the unit body.

4. The household appliance door of claim 1, wherein the aluminum profile has a lower surface facing an internal area of the door, wherein the lower surface includes a pair of first openings, and wherein the guide has lateral claws that engage the pair of first openings of the aluminum profile.

5. The household appliance door of claim 1, wherein the guide includes a mounting hole, and wherein the panel fixing element has a fixing hole coaxial with the mounting hole of the guide.

6. The household appliance door of claim 1, wherein the guide has lateral claws and restrictive end parts, and wherein the restrictive end parts are in a middle area of the guide between the lateral claws.

7. The household appliance door of claim 6, wherein the aluminum profile comprises an emptied profile part for receiving bearings, a pair of first openings for receiving the claws, second openings for mounting the lateral covering, a slot for receiving the guide, and a protrusion for restricting the guide in a mounted position on the aluminum profile.

8. The household appliance door of claim 1, wherein the aluminum profile includes a pair of first openings and a protrusion for restricting the guide in a mounted position on the aluminum profile, wherein the guide includes a middle portion having restrictive end parts and lateral claws, the middle portion being between the lateral claws, wherein the lateral claws engage the pair of first openings of the aluminum profile and the middle portion engages the protrusion for restricting the guide in the mounted position on the aluminum profile.

* * * * *